US005529132A

United States Patent [19]

Evarts

[11] Patent Number: 5,529,132

[45] Date of Patent: Jun. 25, 1996

[54] HYDRAULIC CONTROL CIRCUIT FOR PILE DRIVER

[75] Inventor: Kingsley S. Evarts, Pittsburgh, Pa.

[73] Assignee: J & M Hydraulic Systems, Inc., Pittsburgh, Pa.

[21] Appl. No.: 474,758

[22] Filed: Jun. 7, 1995

Related U.S. Application Data

[62] Division of Ser. No. 164,063, Dec. 8, 1993, Pat. No. 5,474,138.

[51] Int. Cl.[6] ..... B23Q 5/033

[52] U.S. Cl. ..... 173/1; 173/4; 173/13; 173/115; 173/152; 91/268; 91/397; 91/403

[58] Field of Search ..... 173/1, 2, 4, 9, 173/11, 13, 15, 206, 207, 208, 152, 115; 91/268, 272, 5, 397, 403, 448

[56] References Cited

U.S. PATENT DOCUMENTS

| | | | |
|---|---|---|---|
| 3,333,646 | 8/1967 | Hoen et al. | 173/152 |
| 3,381,764 | 5/1968 | Peterson et al. | 173/115 |
| 4,050,526 | 9/1977 | Deike | 173/115 |
| 4,429,751 | 2/1984 | Jackson et al. | 173/13 |
| 5,168,937 | 12/1992 | Hamner | 173/4 |

*Primary Examiner*—Scott A. Smith

*Attorney, Agent, or Firm*—Webb Ziesenheim Bruening Logsdon Orkin & Hanson

[57] ABSTRACT

A pile driver arrangement including a reciprocal impact member connected to a piston rod which is also connected to a reciprocal piston located in a hydraulic cylinder having a lower rod end and an upper blind end. A hydraulic fluid tank and a pump for supplying hydraulic fluid from the tank to the lower rod end of the hydraulic cylinder to lift the piston and the impact member. A first hydraulic fluid conduit connecting the upper blind end of the hydraulic cylinder and the lower end of the hydraulic cylinder and a check valve to prevent the flow of hydraulic fluid from the lower end to the upper end of the hydraulic cylinder. A second hydraulic fluid conduit connecting the pump and the lower end of the hydraulic cylinder and a control valve in the second conduit for controlling the flow of hydraulic fluid from the pump to the lower end of the hydraulic cylinder. A third hydraulic fluid conduit connecting the pump to an adjustable trip valve for adjusting the position of the control valve to control the flow of hydraulic fluid from the pump to the lower end of the hydraulic cylinder. A fourth hydraulic fluid conduit connecting the trip valve and the control valve.

4 Claims, 1 Drawing Sheet

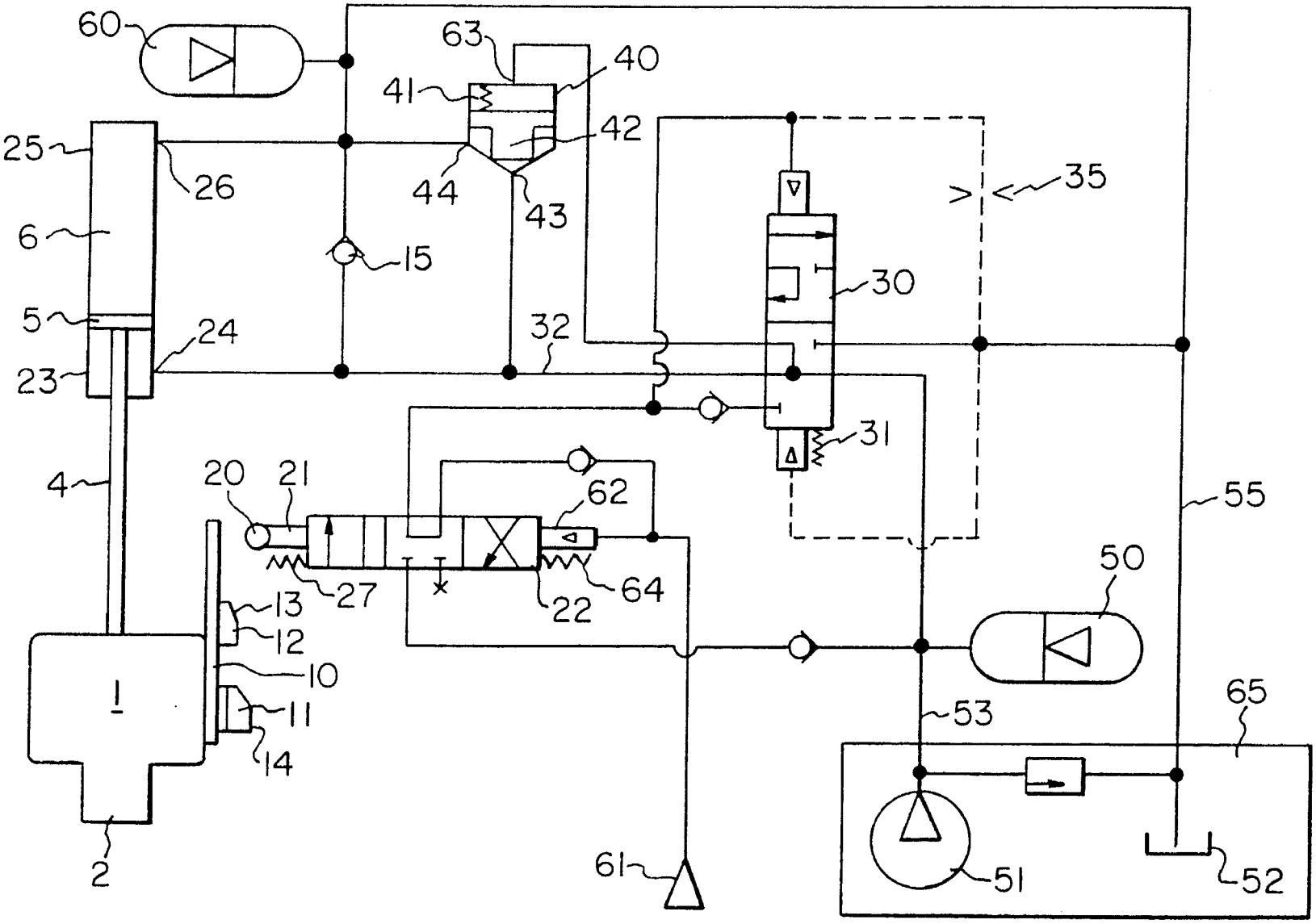
55
65
52
50
35
51
53
30
31
40
42
43
32
62
64
22
61
63
41
44
15
27
21
13
12
10
11
14
20
60
26
24
25
6
5
23
4
1
2

HYDRAULIC CONTROL CIRCUIT FOR PILE DRIVER

This is a divisional of application Ser. No. 08/164,063 filed on Dec. 8, 1993, now U.S. Pat. No. 5,474,138.

BACKGROUND OF THE INVENTION

1. Field of the Invention

The invention relates generally to a fluid-actuated impact member or ram such as a pile driver and more particularly to a hydraulic control circuit for operating a fluid-actuated impact member or ram for driving piles and other related operations.

2. Description of Related Art

An impact member is a heavy mass suspended at the end of a support mechanism. The impact member is guided for reciprocal movement in a downward working stroke and an upward return stroke. A control system for such an impact member is disclosed in U.S. Pat. No. 3,408,897 entitled "Fluid Power Hammer Having Accumulator Means to Drive the Hammer Through Its Working Stroke Independent of the System Pump". That patent discloses an impact tool hydraulic control circuit which is self-regulating and has built-in safety features to avoid damage to the mechanism or to the circuitry. However, the control circuit disclosed in that patent has certain inadequacies. For example, as shown in FIG. 6 of the drawings of that patent, a trip rod mechanically pushes a control valve spool rod 196 to the fall position at a preselected height of the impact member 11, and when impact member 11 is falling, exhausting fluid must move a sleeve 198 in order to escape to the tank. When sleeve 198 moves, it compresses a spring 199 which also acts on a control valve spool rod 196 to shift sleeve 198 to the drop position against the force of a return spring 218. As long as fluid is passing through sleeve 198, it holds control valve spool rod 196 in the shifted position. However when impact occurs, internal spring 199 returns sleeve 198 to its normal position, and return spring 218 returns control valve spool rod 196 and sleeve 198 to the lift position. When impact tool 11 is operating in the free fall mode, automatic pilot control valve F and control valve A always move together and, therefore, essentially function as a single valve. Because of this arrangement, the spring holds the spool of automatic pilot control valve F in position by mechanical means. Sleeve 198 compresses spring 199 which pushes against the spool of valve F.

The hydraulic pilot arrangement for shifting the position of the control valve spool and holding the control valve spool in the shifted position in the control circuit of the invention is a principal difference between the hydraulic control circuit of the invention and the prior art control circuit. Additionally, the replenishment check valve in the hydraulic control circuit of the invention increases the efficiency of the operation of the impact member and the reliability of the hydraulic control circuit.

SUMMARY OF THE INVENTION

The hydraulic control circuit of the invention includes a replenishment check valve connected between the upper blind end of a hydraulic cylinder and the lower rod end of the hydraulic cylinder to permit hydraulic fluid to flow only from the upper blind end of the hydraulic cylinder to the lower rod end of the hydraulic cylinder. The upper blind end of the hydraulic cylinder is also connected to a tank accumulator and to the hydraulic fluid tank.

In the operation of the hydraulic control circuit of the invention, a cam-like trip member which is carried on the impact member moves a spring-loaded roller mounted on a roller lever in the trip valve to shift the trip valve spool when the impact member is moving upwardly. The trip valve transmits a hydraulic fluid pilot signal to the control valve to shift the control valve spool and, thereby, prevent additional hydraulic fluid from flowing to the lower rod end of the hydraulic cylinder to lift the impact member. The impact member, however, continues to move a considerable distance in the upward direction before the upward motion is stopped because of the inertia of the impact member in the upward direction. This is the deceleration phase of the lift portion of the operating cycle. A vacuum is created in the lower rod end of the hydraulic cylinder during the deceleration phase because no additional hydraulic fluid is available to flow into the lower rod end of the hydraulic cylinder through the lower rod end port. If the vacuum is not removed from the lower rod end of the hydraulic cylinder, cavitation will occur in the lower rod end of the hydraulic cylinder which hampers the smooth continuous movement of the impact member. The replenishment check valve allows hydraulic fluid to flow to the lower rod end of the hydraulic cylinder during the deceleration of the upward movement of the piston in the hydraulic cylinder to relieve the vacuum in the lower rod end of the hydraulic cylinder. This flow of hydraulic fluid ensures that the lower rod end of the hydraulic cylinder remains substantially full of hydraulic fluid at all times during the deceleration of the upward movement of the piston in the hydraulic cylinder. This operation of the control circuit permits the continuous and smooth operation of the heavy impact member with efficient use of the energy imparted to the impact member during the acceleration phase of the lift portion of the operating cycle. Maintaining the lower rod end of the hydraulic cylinder full of hydraulic fluid ensures reliable operation of the hydraulic control circuit during the drop cycle.

In the method of the invention, the trip valve transmits a hydraulic fluid pulse to the control valve to shift the control valve spool. When the impact member is descending, hydraulic fluid escapes from the control valve to open a drop valve. Fluid pressure in the lower rod end of the hydraulic cylinder must exceed the force of the drop valve spring to open the drop valve and permit hydraulic fluid to flow through the drop valve to the tank. The resistance force of the drop valve spring is set at 50 psi although that resistance force may be adjusted. The pressure of the hydraulic fluid at the drop valve inlet must, therefore, be greater than the 50 psi force of the spring in order to overcome the force of the spring and open the drop valve. The excess pressure of 50 psi is connected to the spool end of the control valve and is sufficient to hold the control valve spool against the force of the spool-valve spring. The control valve spool is held in the shifted position throughout the drop portion of the operating cycle of the impact member by the excess pressure. After impact occurs, the flow of hydraulic fluid stops and the 50 psi pressure difference no longer exists. With equal pressure at both ends of the control valve spool, the spool spring returns the spool to the normal position. Thus, in the hydraulic control circuit of the invention, the impact member initially shifts the control valve spool by a hydraulic pilot pressure, and during the drop portion of the operating cycle of the impact member, the control valve spool is held in the shifted position by the 50 psi differential pressure. The hydraulic pilot pressure differential signal is generated by the drop valve spring force.

Significantly, the return of the control valve spool to its normal position, to initiate the beginning of another lift portion of the operating cycle, is not signalled at a specific location of the impact member during its downward movement. The cessation of flow of hydraulic fluid from the lower rod end of the hydraulic cylinder at impact initiates the lift portion of the operating cycle regardless of where the impact occurs during the downward movement of the impact member. Thus, damage to the actuator or a reduction of impact energy, which would be caused by a premature reversal of the direction of movement of the piston in the hydraulic cylinder, is prevented. When driving piles, the actual location of impact is often uncertain due to inaccuracies in the position of the end of the pile; the use of a pile adapter or a striker block; and relative movement between the impact member frame and the pile which is being driven.

A complete understanding of the invention will be obtained from the following description when taken in connection with the accompanying drawing FIGURE.

BRIEF DESCRIPTION OF THE DRAWING

The drawing FIGURE is a hydraulic control circuit for a fluid-actuated impact member.

DESCRIPTION OF THE PREFERRED EMBODIMENT

The hydraulic control circuit shown in the drawing FIGURE controls the operating cycle of a vertically movable impact member 1 which is slideably mounted in a frame (not shown). Impact member 1 has a lower contact end 2 which is adapted to impact on a pile or a pile adapter device such as a striker block to drive the pile into the earth. A vertically movable piston rod 4 has its lower end attached to the upper end of impact member 1 and its upper end attached to the lower surface of a vertically movable piston 5 in a hydraulic cylinder 6 which is mounted on the frame. Hydraulic cylinder 6 has a port 24 at the lower rod end 23 and a port 26 at the upper blind end 25. Hydraulic fluid flows into and out of the lower and upper ends of hydraulic cylinder 6 through ports 24 and 26, respectively, in accordance with the movement of piston 5 along the hydraulic cylinder and the position of the valves in the hydraulic control circuit.

A support member 10 is fixed to a vertical surface of impact member 1 and a pair of cam-like trip members 11 and 12 are attached to the support member and extend outwardly from the support member toward a trip valve 22. Each trip member extends a different distance outwardly from support member 10 and each trip member has an angled cam surface 13 and a flat cam surface 14 on its free end to contact a roller 20 mounted on the end of a slideable roller lever 21 which extends out of the housing of a trip valve 22 and is aligned with the valve spool to shift the spool against a spring force to actuate the trip valve and provide for different stroke lengths of impact member 1. Trip members 11 and 12 actuate trip valve 22 for short and long strokes of impact member 1. With the spool in trip valve 22 in its normal position, roller 20 will contact the cam surfaces on the end of lower member 11 to obtain a long stroke of impact ram 1. By applying a pilot hydraulic pressure from a remote source of pressure 61 to the end 62 of the trip valve spool opposite roller 20, the spool is shifted longitudinally to extend roller 20 out of the housing of the trip valve 22 and roller 20 will contact the cam surfaces on the end of upper trip member 12 to produce a short stroke of impact member 1. Thus, the stroke of the impact member can be varied by the operator.

Trip valve 22 is a spool-type valve wherein the spool is spring centered and is shifted laterally by the movement of roller lever 21 or by a hydraulic pilot pressure from source 61. Roller lever 21 is extended out of the trip valve housing by a pilot pressure to contact cam surfaces 13 and 14 on the end of the shorter upper trip member 12. In both the short stroke and the long stroke modes of operation, when roller 20 contacts cam surfaces 13 and 14, trip valve 22 transmits a hydraulic pressure signal to a control valve 30 to shift the spool in the control valve.

Control valve 30 controls the flow of hydraulic fluid to the lower rod end of hydraulic cylinder 6 and is in fluid flow connection with port 24 of the hydraulic cylinder. Control valve 30 is a spool-type, two-position valve with a spring offset. The spool is slideably mounted in the valve housing for longitudinal movement between the two positions. The main flow land and the pilot flow land are located on the spool of control valve 30. A pilot piston is located on each end of control valve 30 to control the position of the spool. A 0.09 inch diameter orifice 35 is formed in the longitudinal axis of the spool, in the present embodiment to limit the flow of hydraulic fluid therethrough.

The hydraulic control circuit also includes a drop valve 40 connected between ports 24 and 26 of hydraulic cylinder 6. Drop valve 40 is a high-capacity, poppet-type, spring-loaded valve which includes a biasing spring 41 which normally holds a poppet 42 located at the inlet end of the valve housing in the closed position to close ports 43 and 44. The spring has a preselected force of 50 psi in the present hydraulic control circuit although the spring force can be varied by selecting different springs. Thus, hydraulic fluid at port 43 of valve 40 must have a pressure in excess of 50 psi to open drop valve 40. A pilot pressure at a port 63 behind poppet 42 also holds the poppet in the closed position during the lift portion of the operating cycle.

A pressure accumulator 50 is connected to a pump 51 to store excessive pressurized hydraulic fluid passing from the pump in the direction of control valve 30. The quantity of hydraulic fluid which can be stored in accumulator 50 is determined by the pressure of a gas, such as nitrogen, on the face of a movable piston or a flexible bladder which is opposite to the face in contact with the pressurized hydraulic fluid. In the hydraulic control circuit of the present invention, the pressure of the nitrogen gas in pressure accumulator 50 is set at approximately 1200 psi on one side of the piston or the bladder in the pressure accumulator. Hydraulic fluid will be stored in pressure accumulator 50 when the pressure of the hydraulic fluid exceeds the 1200 psi pressure of the nitrogen gas, and the nitrogen gas is compressed to increase its pressure until equilibrium is reached between the pressure of the nitrogen gas and the pressure of the hydraulic fluid stored in pressure accumulator 50.

A tank accumulator 60 is connected between port 26 in blind end 25 of hydraulic cylinder 6 and a tank 52. A gas under pressure such as nitrogen is located in accumulator 60 on one side of either a movable piston or a flexible bladder. Hydraulic fluid enters accumulator 60 when the pressure of the hydraulic fluid exceeds the pressure of the nitrogen and the nitrogen is compressed to increase its pressure until equilibrium is reached with the pressure of the stored hydraulic fluid.

A replenishment check valve 15 is connected in the hydraulic control circuit between upper blind end port 26 and lower rod end port 24 of hydraulic cylinder 6. The replenishment check valve permits flow of hydraulic fluid from upper blind end 25 to lower rod end 23 of hydraulic cylinder 6 to eliminate cavitation in the lower rod end of the hydraulic cylinder during the deceleration of the impact member as it moves in the upward direction during the lift portion of the operating cycle. The deceleration of impact member 1 creates a vacuum in the lower end of the hydraulic cylinder which permits flow from upper blind end 25 to lower rod end 23 because the pressure in the lower rod end is negative. Flow from the lower rod end to the upper blind end of hydraulic cylinder 6 is prevented during the lift portion of the operating cycle by replenishment check valve 15. The replenishment check valve may be a Rexroth check valve model #RVP401/0.

Both pump 51 and tank 52 are located in a hydraulic power source 65 which is remote from the impact member. Pump 51 is rotatably driven by a standard prime mover (not shown) which is also included in power source 65. The power source may be either a self-contained unit or may be integrated into a crane or similar lifting equipment used to handle the impact member. Well-known apparatus for excess pressure protection, fluid cooling and filtration are also included into the power source.

A connection for conducting pressurized fluid from pump 51 to control valve 30 is provided in the form of an elongated flexible hose having a length sufficient to permit the impact member to be easily positioned above the piles to be driven. A connection for conducting return fluid from upper blind end 26 of hydraulic cylinder 6 is provided in the form of an elongated flexible hose having a length sufficient to permit the impact member to be easily positioned above the piles to be driven.

A connection for conducting a pressurized pilot signal from power source 65 to trip valve 22 to extend roller lever 21 out of the valve housing and move roller 20 toward the short stroke position is provided in the form of an elongated flexible hose having a length sufficient to permit impact member 1 to be positioned above the piles to be driven.

Pump 51 in power source 65 is capable of pumping hydraulic fluid at pressure up to 2500 psi in the present embodiment. The size of the control valve and the size of the hydraulic cylinder may be altered to accommodate other pressures.

In the following explanation of the hydraulic control circuit, the starting position of impact member 1 is assumed to be the lower impact position. With no pressure in the system, the spool in control valve 30 is held in its "normal" position by spring 31. The spool in trip valve 22 is held in the centered position by opposed springs 27 and 64 and poppet 42 in drop valve 40 is held in the closed position by spring 41. Both of the hydraulic fluid accumulators 50 and 60 are empty.

A complete operating cycle of impact member 1 consists of the following three phases: 1) lift-acceleration, 2) lift-deceleration, and 3) drop. The operating cycle proceeds according to the following sequence.

Pressurized hydraulic fluid is introduced to control valve 30 through conduit 53 by pump 51. The hydraulic fluid is directed by control valve 30 to port 24 at lower rod end 23 of hydraulic cylinder 6 through conduit 32. The pressurized hydraulic fluid exerts an upward force on the lower surface of piston 5 and moves the piston and piston rod 4 upwardly which lifts impact member 1 at an accelerated rate due to the increasing volume of fluid supplied to lower rod end 23 of hydraulic cylinder 6. During the acceleration phase of the lift portion of the operating cycle, piston 5 and impact member 1 initially move upwardly at a rate which is less than the rate which would result from full flow of hydraulic fluid from pump 51. That portion of the hydraulic fluid which is not used to lift piston 5 and impact member 1 is stored, under pressure, in pressure accumulator 50. Therefore, the upward movement of the impact member may-be accelerated to a velocity which is greater than the upward velocity which is obtainable from the pump flow alone because the hydraulic fluid which is stored under pressure in pressure accumulator 50 supplements the flow of hydraulic fluid from pump 51.

The pressurized hydraulic fluid cannot flow from conduit 32 through replenishment check valve 15 because the valve is a one-way valve which permits flow only from port 26 at upper blind end 25 of hydraulic cylinder 6 to port 24 at lower rod end 23 of the hydraulic cylinder. When the spool of control valve 30 is in its normal position, a pilot flow of hydraulic fluid having a pressure equal to the pressure of the fluid discharged from pump 51 is directed to the rear surface of spring-loaded poppet 42 in drop valve 40. The force which the pressurized hydraulic fluid provides to the rear surface of poppet 42 plus the force of spring 41 holds poppet 42 in the closed position to prevent hydraulic fluid from flowing through drop valve 40.

Upper blind end 25 of hydraulic cylinder 6 is continuously connected to tank 52 and to tank accumulator 60, so that as piston 5 moves rapidly upwardly, hydraulic fluid is exhausted from blind end 25 of the hydraulic cylinder through port 26 and flows to tank 52 through a return hose 55. Because of the difference in volume between lower rod end 23 of hydraulic cylinder 6 and upper blind end 25 of hydraulic cylinder 6, a larger amount of fluid exits the upper blind end of the hydraulic cylinder through port 26 than enters the rod end of the hydraulic cylinder through port 24. Excessive back pressure results from trying to force the flow of hydraulic fluid through return hose 55 to tank 52 and a portion of the hydraulic fluid flows into tank accumulator 60. This hydraulic fluid is subsequently exhausted from accumulator 60 to tank 52 through return hose 55 during the drop portion of the operating cycle. Tank accumulator 60 thus serves to smooth out what would otherwise be an intermittent flow through return hose 55 and thereby substantially eliminates flexing of the hose which minimizes jumping and jerking of the hose. Tank accumulator 60 also provides hydraulic fluid to upper blind end 25 of hydraulic cylinder 6 during the drop portion of the operating cycle, and replenishment flow to lower rod end 23 of the hydraulic cylinder through check valve 15 during the lift-deceleration phase of the lift portion of the operating cycle.

As the movement of impact member 1 continues in the upward direction, the cam surfaces on one of trip members 11 or 12 contact roller 20 on roller lever 22 of trip valve 21 to shift the lever relative to the valve housing to move the trip valve spool toward the end of the trip valve housing opposite spring 27 to compress spring 64. In this position the trip valve spool directs hydraulic fluid at pump pressure to the pilot piston on the end of the control valve spool opposite spring 31. When a force greater than the force of spring 31 is generated by the pressure on the pilot piston, the spool is shifted against the force of the spring. Fluid under pressure in the pilot piston constantly leaks to tank 52 through orifice 35 located in the longitudinal axis of the spool. The orifice has a diameter of 0.09 inch although the orifice size can be varied in accordance with operating characteristics. The leakage through orifice 35 is relatively small and is easily compensated for by pump 51. Because roller 20 in trip valve 22 remains in contact with the flat cam surface on one of trip members 11 or 12 throughout the deceleration phase of the lift portion of the operating cycle (lift-deceleration), hydraulic fluid under pressure is continuously applied to the pilot piston during this phase in the cycle.

When control valve 30 is in the shifted position, the spool prevents hydraulic fluid from flowing from pump 51 to hydraulic cylinder 6 and thereby initiates the lift-deceleration phase of the lift portion of the operating cycle. When the control valve spool is shifted, it removes pilot pressure from the rear surface of poppet 42 in drop valve 40. The inertia of the upwardly moving impact member prevents it from stopping immediately when pressurized fluid is removed from rod end 23 of hydraulic cylinder 6. Gravity decelerates the movement of the impact member 1 from its lift velocity to zero during the deceleration phase of the lift portion of the operating cycle. During the deceleration phase of the upward stroke, a vacuum is created in lower rod end 23 of hydraulic cylinder 6 because no hydraulic fluid flows into the lower rod end of the hydraulic cylinder from pump 51. Replenishment check valve 15 prevents cavitation from occurring in lower rod end 23 of hydraulic cylinder 6 because hydraulic fluid is allowed to freely flow from upper blind end 25 of hydraulic cylinder 6 to lower rod end 23 through the replenishment check valve and the vacuum in the lower rod end of the hydraulic cylinder is thereby relieved. The replenishment check valve ensures that lower rod end 23 of hydraulic cylinder 6 remains full of hydraulic fluid during the entire deceleration phase of the lift portion of the upward stroke of piston 5 and that no gas is trapped in lower rod end 23 during this deceleration portion phase of the lift portion of the operating cycle of the impact member. Relieving the negative pressure on piston 5 ensures free and efficient upward movement of impact member 1 and ensures that lower rod end 23 of cylinder 6 is completely full of fluid at the end of the deceleration portion of the operating cycle.

When impact member 1 is moving downwardly during the drop portion of the operating cycle, gravity accelerates the rate of movement. Because the rear of poppet 42 in drop valve 40 is connected to tank 52, the only force holding the poppet closed during the drop portion of the operating cycle is the 50 psi force of spring 41 in the drop valve. The drop valve effectively provides a small, predetermined back pressure in the conduit between hydraulic cylinder lower rod end 23 and hydraulic cylinder upper blind end 25. The short duration high flow rate pulse of hydraulic fluid exiting lower rod end 23 of hydraulic cylinder 6 is easily absorbed by upper blind end 25 of hydraulic cylinder 6 during the drop portion of the operating cycle. The partial vacuum generated in the upper blind end of the hydraulic cylinder 6 during the drop portion is filled by the fluid exiting from lower rod end 25 of the hydraulic cylinder and, if necessary, from fluid stored in tank accumulator 60.

During the drop portion of the operating cycle, hydraulic fluid flows through drop valve 40 because the fluid pressure is sufficient to open poppet 42 against the 50 psi force of spring 41. The spring holds the poppet closed in normal conditions and therefore the pressure of the hydraulic fluid which flows through drop valve 40 must be 50 psi greater at port 43 of the drop valve than at port 44 of the drop valve which is at tank pressure. When trip member 11 or 12 falls below trip valve roller 20, hydraulic fluid at pump pressure is no longer applied to the spool pilot piston. However, a 50 psi pressure difference still exists between lower rod end 23 of hydraulic cylinder 6 and the tank return hose or upper blind end 25 of hydraulic cylinder 6 because of the flow through drop valve 40. When the control valve is in the shifted position, the lower rod end of hydraulic cylinder 6 is connected to the control valve pilot piston at the end of the spool opposite spring 31. The spring end of the pilot piston at the spring end of the spool is continuously connected to tank return hose 55. The 50 psi generated at drop valve 40, when connected to the pilot piston, is sufficient to hold the spool shifted against the force of spring 31. Fluid in the pilot piston constantly leaks to tank 52 through the 0.09 inch diameter orifice in the longitudinal axis of the spool. This leakage is relatively small and is easily made up by fluid exhausting from lower rod end 23 of hydraulic cylinder 6.

The drop portion of the operating cycle ends when impact member 1 contacts the end of a pile or a pile adapter. The elevation of the impact member when it contacts the pile or the pile adapter is not critical to the operation of the system. This is because hydraulic fluid no longer exits from the lower rod end of hydraulic cylinder 6 when the movement of the impact member stops, and therefore hydraulic fluid no longer flows through drop valve 40. Stopping the flow of hydraulic fluid eliminates the 50 psi pressure difference between the ends of the control valve spool. The orifice in the longitudinal axis of the spool of control valve 30 permits fluid to leak from one end of the spool to the other end and equalizes the pressure against the ends of the spool. Spool spring 31 then shifts the spool in the valve housing back to the starting position to begin another lift portion of the operating cycle.

During the entire lift-deceleration phase of the lift portion and the drop portion of the operating cycle, the flow of hydraulic fluid from pump 51 is prevented from entering hydraulic cylinder 6 and is stored in pressure accumulator 50. The energy of this stored pressurized hydraulic fluid is used to supplement the acceleration of the impact member in the lift portion of the cycle as described hereinabove.

While a specific embodiment of the invention has been described in detail herein, it will be appreciated by those skilled in the art that various modifications and alternatives to this embodiment can be developed in light of the overall teachings of the disclosure. Accordingly, the particular arrangement is illustrative only and is not limiting as to the scope of the invention which is to be given the full breadth of the appended claims and any and all equivalents thereof.

I claim:

1. A method of operating a pile driver arrangement having:

a) a reciprocal impact member having a lower contact end and an upper end and contact means on said impact member for operating a trip valve, b) a hydraulic cylinder having a lower rod end and an upper blind end located above said impact member upper end, c) a reciprocal piston axially movable in said hydraulic cylinder, d) a piston rod connecting said impact member upper end to said reciprocal piston, whereby upward movement of said reciprocal piston in said hydraulic cylinder lifts said impact member, e) a first hydraulic fluid conduit means connecting said upper blind end of said hydraulic cylinder and said lower rod end of said hydraulic cylinder, f) a hydraulic fluid storage tank, g) supplying hydraulic fluid under pressure via a pump from said storage tank to said lower rod end of said hydraulic cylinder to move said piston upwardly in said hydraulic cylinder and thereby lift said impact member, h) a second hydraulic fluid conduit means connecting said pump and said lower rod end of said hydraulic cylinder, i) controlling the flow of pressurized hydraulic fluid through said second conduit means from said pump to said lower rod end of said hydraulic cylinder via a control valve, a longitudinally spring loaded spool in said control valve and an orifice in said spool to permit a constant leakage of hydraulic fluid through said control valve to said tank, j) a third hydraulic fluid conduit means adapted to connect said pump to an adjustable trip valve, k) shifting the longitudinal position of said spring loaded spool in said control valve via an adjustable trip valve connected to said third conduit means to control the flow of hydraulic fluid from said pump to said lower rod end of said hydraulic cylinder and an adjustable control member in said trip valve, l) a fourth hydraulic fluid conduit means connecting said trip valve and said control valve whereby movement of said adjustable control member in said trip valve by said contact means on said impact member shifts the position of said spring loaded spool in said control valve, m) limiting the flow of hydraulic fluid via a replenishment check valve in said first conduit means from only said upper blind end of said hydraulic cylinder to said lower rod end of said hydraulic cylinder to fill said lower rod end of said hydraulic cylinder when said piston is decelerating upward after said adjustable control member in said trip valve is adjusted to permit hydraulic pressure in said fourth conduit means to shift the longitudinal position of said spring loaded spool in said control valve, n) additional hydraulic fluid conduit means connecting said upper blind end of said hydraulic cylinder and said tank, o) a fifth hydraulic fluid conduit means connecting said lower rod end of said hydraulic cylinder and said upper blind end of said hydraulic cylinder, p) a drop valve located in said fifth conduit means, said drop valve having first and second ports connected to said fifth hydraulic fluid conduit means and a third port connected to a sixth hydraulic fluid conduit means, q) said sixth hydraulic fluid conduit means connecting said third port of said drop valve to said control valve, whereby a pilot pressure is supplied from said control valve to said third port of said drop valve, and r) holding said poppet in the closed position during the upward movement of said impact member, whereby during the drop portion of the operating cycle of said impact member when said control valve is in the shifted position, hydraulic fluid flow in said fifth conduit means is sufficient to open said poppet of said drop valve and flow into said upper blind end of said hydraulic cylinder, said control valve being held in the shifted position by differential hydraulic pressure as generated by said biasing means on said drop valve poppet in said fifth conduit means.

2. A method of operating a pile driver arrangement as set forth in claim 1 including supplementing the flow of pressurized fluid via a pressure accumulator in fluid flow communication with said second conduit means for accumulating pressurized fluid from said pump to supplement the flow of pressurized fluid through said second conduit means to said lower rod end of said hydraulic cylinder to accelerate the rate of upward movement of said piston in said hydraulic cylinder in combination with the normal pump flow.

3. A method of operating a pile driver arrangement as set forth in claim 1 including a plurality of spaced trip members located on said impact member, each of said trip members having an angled cam surface, contacting said adjustable control member in said trip valve by one of said angled cam surfaces as said impact member is lifted by raising said piston in said hydraulic cylinder to control the pressurized hydraulic fluid flowing from said trip valve to said control valve thereby preventing pressurized hydraulic fluid from flowing from said pump to said lower rod end of said hydraulic cylinder to begin deceleration of the upward movement of said piston in said hydraulic cylinder and of said impact member connected to said piston.

4. A method of operating a pile driver arrangement as set forth in claim 3 wherein said adjustable control member in said trip valve is a lever extending from said trip valve and a roller located on the distal end of said lever for contacting an angled cam surface on one of said trip members as said impact member is lifted.

* * * * *